US008920121B2

(12) United States Patent
Dungs et al.

(10) Patent No.: US 8,920,121 B2
(45) Date of Patent: Dec. 30, 2014

(54) AXIAL TURBOMACHINE ROTOR HAVING A SEALING DISK

(75) Inventors: Sascha Dungs, Wesel (DE); Peter Schröder, Essen (DE)

(73) Assignee: Siemens Aktiengesellschaft, Munich (DE)

( * ) Notice: Subject to any disclaimer, the term of this patent is extended or adjusted under 35 U.S.C. 154(b) by 583 days.

(21) Appl. No.: 13/260,585

(22) PCT Filed: Mar. 26, 2010

(86) PCT No.: PCT/EP2010/054001
§ 371 (c)(1), (2), (4) Date: Sep. 27, 2011

(87) PCT Pub. No.: WO2010/112422
PCT Pub. Date: Oct. 7, 2010

(65) Prior Publication Data

US 2012/0034087 A1 Feb. 9, 2012

(30) Foreign Application Priority Data

Mar. 31, 2009 (EP) ..... 09004781

(51) Int. Cl.

| | |
|---|---|
| ***F01D 5/02*** | (2006.01) |
| ***F01D 5/03*** | (2006.01) |
| ***F01D 11/00*** | (2006.01) |
| ***F01D 5/30*** | (2006.01) |

(52) U.S. Cl.
CPC ..... *F01D 5/3015* (2013.01); *F01D 11/006* (2013.01)
USPC ..... 416/97 R; 416/219 R; 416/220 R; 416/221; 416/248

(58) Field of Classification Search
CPC ..... F01D 11/006; F01D 5/3015
USPC ..... 416/95, 96 R, 97 R, 219 R, 220 R, 221, 416/248
See application file for complete search history.

(56) References Cited

U.S. PATENT DOCUMENTS

| | | | | |
|---|---|---|---|---|
| 4,484,858 | A | 11/1984 | Kurosawa et al. | |
| 4,854,821 | A * | 8/1989 | Kernon et al. | 416/220 R |
| 5,445,499 | A * | 8/1995 | Charbonnel | 416/220 R |
| 5,622,475 | A * | 4/1997 | Hayner et al. | 416/220 R |
| 6,106,234 | A * | 8/2000 | Gabbitas | 416/221 |

(Continued)

FOREIGN PATENT DOCUMENTS

| | | | |
|---|---|---|---|
| CN | 101258305 | A | 9/2008 |
| EP | 1464792 | A1 | 10/2004 |
| GB | 2095763 | A | 10/1982 |
| GB | 2148404 | A | 5/1985 |
| JP | 58096105 | A | 6/1983 |

(Continued)

*Primary Examiner* — Igor Kershteyn

(57) ABSTRACT

An axial turbomachine rotor is provided. The turbomachine includes a rotor body designed in a rotation symmetrical manner around the rotor axis, a rotor blade ring including rotor blades that are each fixed to the rotor body by the blade foot thereof and a sealing disc designed in a rotation symmetrical manner around the rotor axis that is arranged having the outer edge thereof radially inside, neighboring an axially extending protrusion of the blade foot, so that a hollow space is formed between the blade foot and the sealing disc, wherein a groove exists on the outer edge leading radially to the outside, wherein a sealing ring is mounted that may slide radially to the outside in the groove during operation of the rotor by centrifugal force until the sealing ring radially contacts the inside of the protrusion and thus seals the hollow space on the blade foot.

8 Claims, 4 Drawing Sheets

(56) References Cited

U.S. PATENT DOCUMENTS

| | | | | |
|---|---|---|---|---|
| 6,146,091 | A | 11/2000 | Watanabe et al. | |
| 7,238,008 | B2 * | 7/2007 | Bobo et al. | 416/220 R |
| 2005/0265849 | A1 | 12/2005 | Bobo et al. | |

FOREIGN PATENT DOCUMENTS

| | | | |
|---|---|---|---|
| JP | 11247621 | A | 9/1999 |
| JP | 11257015 | A | 9/1999 |
| WO | WO 2007028703 | A1 | 3/2007 |

* cited by examiner

FIG 2 Detail A
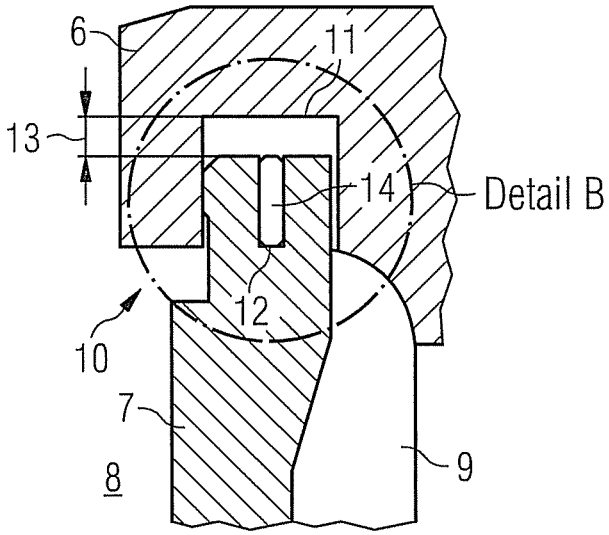
FIG 3 Detail B
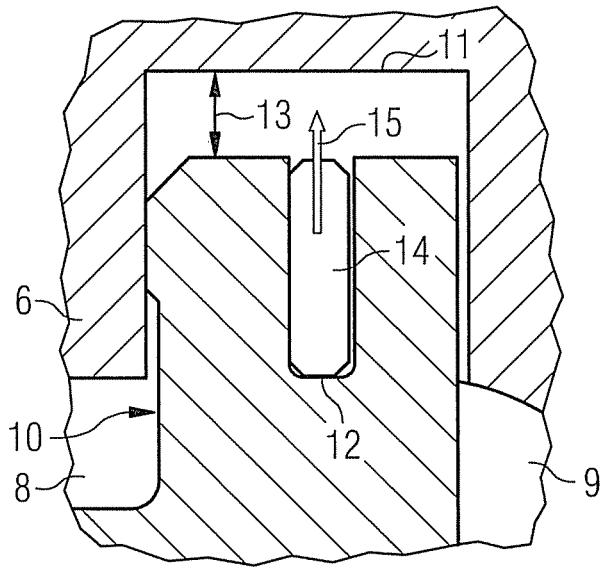

FIG 5 Detail D
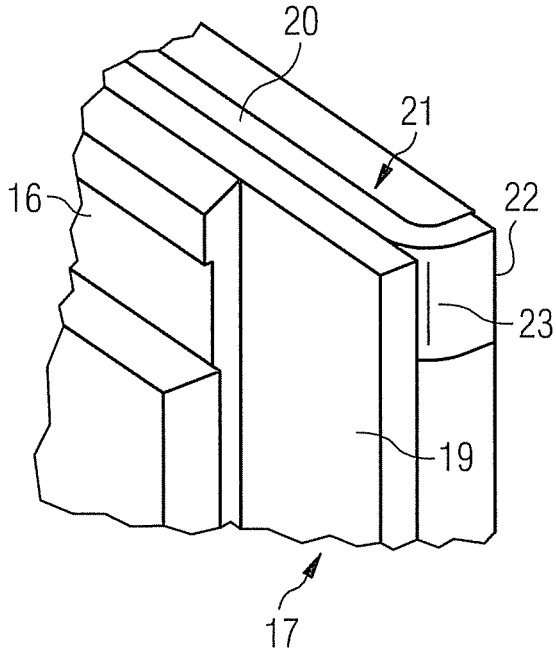
FIG 6 Detail C
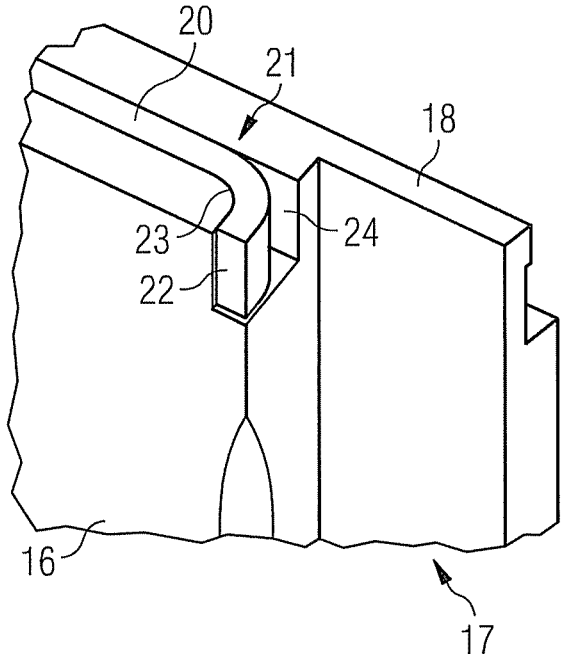

AXIAL TURBOMACHINE ROTOR HAVING A SEALING DISK

CROSS REFERENCE TO RELATED APPLICATIONS

This application is the U.S. National Stage of International Application No. PCT/EP2010/054001, filed Mar. 26, 2010 and claims the benefit thereof. The International Application claims the benefits of European Patent Office application No. 09004781.2 EP filed Mar. 31, 2009. All of the applications are incorporated by reference herein in their entirety.

FIELD OF INVENTION

The invention refers to an axial turbomachine having a sealing plate.

BACKGROUND OF INVENTION

An axial turbomachine, for example a gas turbine, has a turbine in which hot gas is expanded. For achieving high thermal efficiency of the gas turbine, the temperature of the hot gas at the inlet into the turbine is to be selected as high as possible. The maximum achievable temperature level of the hot gas is limited by strength requirements of the turbine which are defined by construction and material selection of the components of the turbine. The temperature load and the mechanical stress of the components define their service life which for reasons of reliability and economy has to lie above specified limits.

A conventional turbine rotor has a shaft and disks which are rotationally symmetrically attached thereupon, on the outer edge of which disks are fastened a multiplicity of rotor blades which lie next to each other over the circumference. The rotor blades and the disks are sometimes the most severely stressed components in the turbine, as a result of which maintenance cycles of the gas turbine are defined principally by these components. For extending the running times of the rotor blades and of the disks, it is known to cool the rotor blades and the disks with cooling air which is conventionally tapped from a compressor of the gas turbine. The rotor blades are especially produced from an intricate structure which is traversed by cooling passages through which flows the cooling air for cooling the rotor blades. The cooling passages open into the rotor blade root at which the cooling passages are fed with the cooling air.

Conventionally, such as in the case of the design according to US 2005/0265849 A1, provision is made on the disk in the region of the blade root for a cooling air inflow passage which is formed between the disk and an annular sealing plate which is adjacent thereto and is directly adjacently arranged radially on the blade root. Design demands are made on the one-piece, platform-like sealing plate to the effect of minimizing leakage of cooling air as far as possible and of preventing entry of hot gas into the cooling passages. For this reason, the sealing plate, on its radially outer edge, is provided with a sealing ring which, by centrifugal force, comes to bear against the undersides of the platforms of the blades.

Instead of a sealing ring, a seal-point may also be provided. However, on account of different thermal expansions of the components and also on account of the relative position of the sealing plate and of the blade root to each other resulting therefrom during operation of the axial turbomachine rotor, wear of the seal-points ensues. As a result, the sealing effect of the seal-points is degraded so that at the sealing plate cooling air can flow into the hot gas region of the turbine.

Furthermore, there is the risk of hot gas, bypassing the seal-points, being able to penetrate into the cooling passages and consequently increase the thermal loading of the rotor blades, as a result of which the risk of a premature failure of the rotor blades is increased.

In addition, an end-face sealing of the cooling air inflow passage, in which instead of a one-piece, annular sealing plate provision is made for a multiplicity of sealing plate segments which jointly form the sealing ring, is known from WO 2007/028703 A1. By centrifugal force, these bear against the undersides of the platforms of the rotor blades. A separate seal by means of a sealing ring is therefore not necessary.

SUMMARY OF INVENTION

It is the object of the invention to create an axial turbomachine rotor which has a long service life.

The axial turbomachine rotor according to the invention has a rotor body, which is formed rotationally symmetrically around the rotor axis, a rotor blade ring, which has a multiplicity of rotor blades which are fastened in each case by their blade root on the rotor body, and a sealing plate, which is rotationally symmetrically formed around the rotor axis and which by its outer edge is arranged radially inside and adjacently on an axially extending projection of the blade root so that between the blade root and the sealing plate a cavity is formed, wherein provision is made on the outer edge for a radially outwards opening groove in which is supported a sealing ring which during operation of the rotor can slide radially outwards in the groove by action of centrifugal force until the sealing ring bears radially against the inner side of the projection and as a result seals the cavity at the blade root.

During operation of the axial turbomachine rotor, a radial relative movement between the projection and the sealing ring ensues. As a result, wear can occur on the sealing ring which can impair the sealing effect of said sealing ring. If the sealing ring is severely worn in such a way that an adequate sealing effect is no longer provided, then the sealing ring can be exchanged on the sealing plate, for example during a maintenance cycle of the axial turbomachine rotor. Consequently, the entire sealing plate advantageously does not need to be exchanged, as a result of which a simple and effective maintenance of the axial turbomachine rotor is achieved. Due to the fact that during operation of the axial turbomachine rotor the sealing ring is pressed onto the projection as a result of the centrifugal force, the sealing ring bears against the projection in a pretensioned manner over the entire circumference. Therefore, the contact between the sealing ring and the projection is well sealed, as a result of which the sealing effect between the projection and the sealing plate is high. If the cavity is a passage, for example, for feeding cooling air to the blade root, as can be provided in a turbine of a gas turbine, for example, then a leakage of cooling air at the sealing ring is small. As a result, cooling of the rotor blades by cooling air is effective, as a result of which the service life of the axial turbomachine rotor is long.

The sealing plate comprises a multiplicity of sealing plate segments, which allows the installation of rotor blades and sealing plate after producing a rotor—welded or stacked from rotor disks—of a stationary gas turbine. Preferably, the sealing plate segments are interconnected in each case in the circumferential direction by a recessed edge. As a result, the installation of the sealing plate on the rotor body is simple, wherein with the aid of the recessed edge gaping of the sealing plate segments in relation to each other is prevented in the case of a misalignment in the circumferential direction of the individual sealing plate segments. In addition, the sealing ring is formed from a multiplicity of sealing ring segments which are arranged in series in the circumferential direction and inserted in each case into the grooves on the outer edge of the sealing plate segment which is associated with them. Consequently, only the sealing ring or its segments are supported on the platforms and rotor blades, which improves the sealing effect. At the same time, the sealing plate segments are now radially directly supported on the rotor disk. As a result, the centrifugal force load of each individual rotor blade fastening can be reduced, which increases the service life of the rotor disk and of the rotor blade.

The sealing ring segments preferably have two long ends, facing away from each other, which are formed in each case by a bend which engages with a recess provided in the groove so that the sealing ring segments are fastened in a form-fitting manner on the outer edge in the circumferential direction. As a result, a displacement of the sealing ring segment in the circumferential direction is advantageously prevented. The bends are preferably designed as legs which are of an L-shaped form in the axial direction. In this case, each of the legs preferably has a curvature radius which is at least greater than half the longitudinal extent of the leg in question. Consequently, the effect is achieved of the sealing ring segment bearing against the sealing plate segment in a gas-tight manner by the long ends. In addition, it is preferred that the legs point in opposite directions so that the sealing ring segment is of a Z-shaped form.

The projection preferably has a radially inwards opening groove in which the outer edge engages in a radially movable manner and against the base of which the sealing ring can bear. As a result, the outer edge of the sealing plate is advantageously accommodated in the groove of the projection, as a result of which harmful influences, especially a mechanical and/or thermal load, upon the sealing ring are reduced. Furthermore, a pressure difference transversely to the sealing ring is reduced so that the sealing effect of the sealing ring is high.

The sealing ring segments are preferably designed as a band with an oblong cross section, the long sides of which extend in the radial direction and the outer short side of which can bear against the blade root. Due to the fact that the long sides of the sealing ring segments extend in the radial direction, the sealing ring segments are guided in the groove of the sealing ring segments during their radial movement. Therefore, twisting and tilting of the sealing ring segments in the grooves of the sealing plate segments is prevented. The axial turbomachine rotor is preferably an axial turbine rotor and the rotor blades preferably have air passages which open into the cavity at the blade root, wherein the cavity is provided for cooling air feed and/or cooling air discharge for the cooling air passages.

BRIEF DESCRIPTION OF THE DRAWINGS

In the following text, a preferred exemplary embodiment of the axial turbine rotor according to the invention is explained with reference to the attached schematic drawings. In the drawings FIG. 2 shows detail A from FIG. 1, FIG. 3 shows detail B from FIG. 1.

FIG. 5 shows detail D from FIG. 4 and

FIG. 6 shows detail C from FIG. 4.

DETAILED DESCRIPTION OF INVENTION

Figure 1:
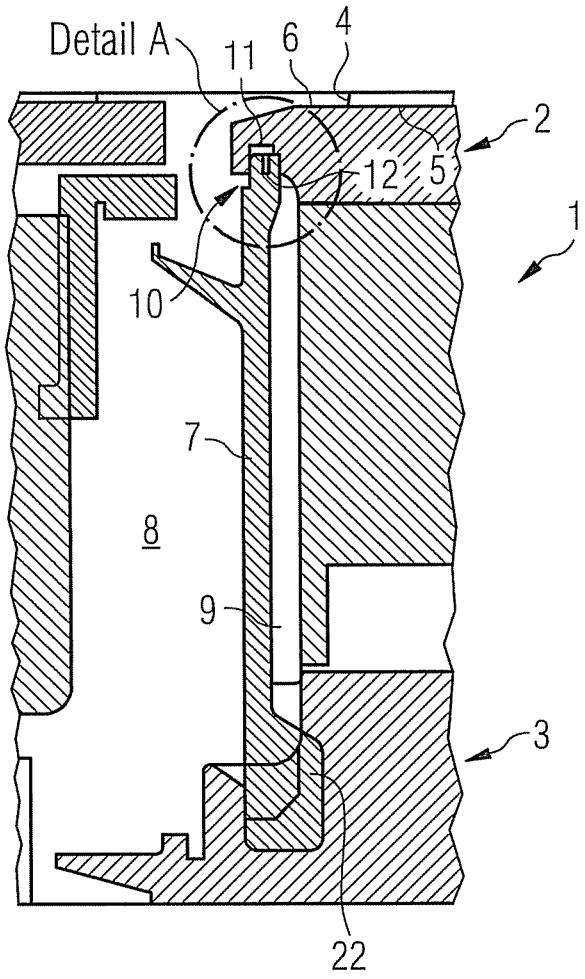
FIG. 1 shows a detail of a longitudinal section of the exemplary embodiment according to the invention of the axial turbine rotor.
Figure 4:
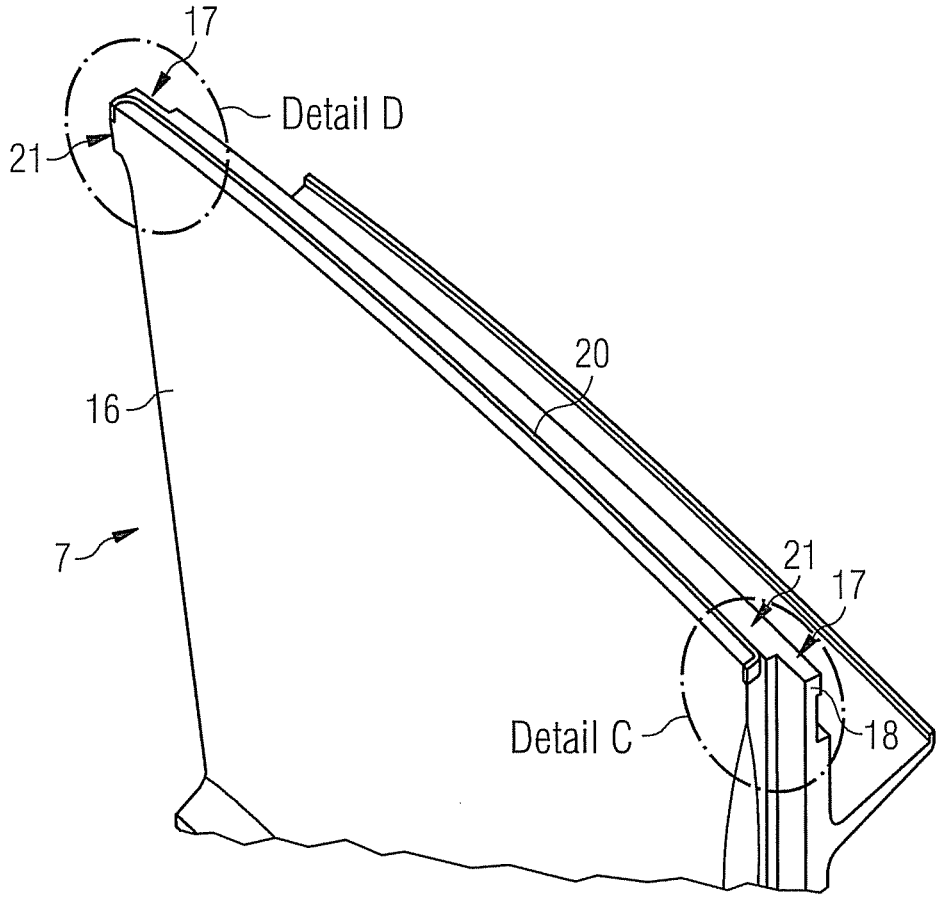
FIG. 4 shows a perspective view of a sealing plate segment.

As is evident from FIGS. 1 to 6, an axial turbine rotor 1 has a multiplicity of rotor blades 2 which are arranged in a row over the circumference of the axial turbine rotor 1 and consequently form a rotor blade cascade. The axial turbine rotor 1 also has a disk 3 on which the rotor blades 2 are fastened. Each rotor blade 2 has a blade airfoil 4 by which the rotor blade 2 is aerodynamically effective. For the fastening of the rotor blade 2, this has a blade root 5 which is retained in a form-fitting manner in the disk 3 so that by the blade root 5 the rotor blade 2 is fixed in the radial direction. Between the blade airfoil 4 and the blade root 5, provision is made for a root plate 6 of the rotor blade 2 which extends in the axial direction and in the circumferential direction and is aerodynamically effective on its radially outer side.

The disk 3 is delimited on the end face by a surface which extends perpendicularly to the axis of the axial turbine rotor. A sealing plate 7 is arranged axially at a distance from this surface, as a result of which a cavity is formed between the sealing plate 7 and the disk 3. As a result, the cavity is delimited from the hot gas side 8 of the axial turbine rotor by the sealing plate 7. The cavity is a cooling air feed passage 9 which is provided for feed of cooling air to the blade root 5. An inner edge 22 of the sealing plate 7, which is thickened with regard to the average wall thickness of said sealing plate 7, is radially hooked into the disk 3, as a result of which the sealing plate 7 is retained radially directly by the disk 3 during operation.

The outer edge 10 of the sealing plate 7 is arranged radially adjacent to the radially inner side of the root plate 6, wherein the outer edge 10 of the sealing plate 7 engages in an encompassing groove 11 which is provided in the radially inner side of the root plate 6. In the outer edge 10 of the sealing plate 7, provision is made for an encompassing groove 12 which opens radially outwards into the groove 11 of the root plate 6. The outer edge 10 of the sealing plate 7 is arranged radially at a distance from the base of the groove 11 in the root plate 6 so that a radial clearance 13 is provided.

A sealing ring 14, which has a cross section which is of an oblong or rectangular form in the radial direction, is inserted in the groove 12 of the sealing plate 7. The groove 12 in the sealing plate 7 is provided deep in the sealing plate 7 in such a way that the sealing ring 14 can be recessed in the groove 12 flush with the outer edge 10 of the sealing plate 7.

During operation of the axial turbine rotor 1, a centrifugal force acts upon the sealing ring 14, leading to a radial movement 15 of said sealing ring. The radial movement 15 is executed by the sealing ring 14 until the sealing ring 14 bears against the base of the groove 11 in the root plate 6. The radial clearance 13 is adapted to the radial extent of the sealing ring 14 in such a way that when the sealing ring 14 bears against the base of the groove 11 in the root plate 6 the sealing ring 14 is still in engagement with the groove 12 in the outer edge 10 of the sealing plate 7.

The sealing plate 7 is formed from a multiplicity of sealing plate segments 16 which are arranged in a row next to each other over the circumference. On their edges, on which the sealing plate segments 16 are arranged adjacently to each other, a recessed edge 17 is formed in each case, the recessed edge being formed by a stop 18 of the one sealing plate segment 16 and a step 19, corresponding to the stop 18, of the other, adjacent sealing plate segment.

Similar to the splitting of the sealing plate 7 into sealing plate segments 16, the sealing ring 14 is divided into sealing ring segments 20, wherein each sealing ring segment 20 spans the outer edge 10 of the sealing plate segment 14 which is associated with it in the circumferential direction. Each sealing ring segment 20 has two long ends 21 which face away from each other. Each long end 21 of the sealing ring segment is bent round in the axial direction, as a result of which a leg 22 is formed on each long end 21 of the sealing ring segment, with which leg the long end 21 of the sealing ring segment is of an L-shaped form. A curvature with a radius 23 is provided on each leg 22, wherein on the outer edge 10 of the sealing plate segment 16 a correspondingly formed cutout 24 is produced. The legs 22 and the cutouts 24 are arranged on the outer edge 10 of the sealing plate segments 16 so that the legs 22 point away from the stop 18 or the step 19 in the axial direction. Therefore, the rigidity of the sealing plate segments 16 in the region of the recessed edge 17 is not excessively impaired as a result of providing the cutout 24.

The invention claimed is:

1. An axial turbomachine rotor, comprising:

a rotor body, which is rotationally symmetrically formed around a rotor axis;

a rotor blade ring, which includes a plurality of rotor blades which are fastened in each case by a blade root on the rotor body; and a sealing plate, which is rotationally symmetrically formed around the rotor axis and which by an outer edge of the sealing plate, is arranged radially inside and adjacently on an axially extending projection of the blade root so that between the blade root and the sealing plate a cavity is formed, wherein provision is made on the outer edge for a radially outwardly opening groove in which is supported a sealing ring which during operation of the rotor may slide radially outwards in the radially outwardly opening groove by action of centrifugal force until the sealing ring bears radially against the inner side of the projection and as a result seals the cavity at the blade root, wherein the sealing plate is formed from a plurality of sealing plate segments and the sealing ring is formed from a plurality of sealing ring segments which are arranged in series in a circumferential direction and are radially supported in each case directly on the rotor body, and wherein the respective sealing ring segments are inserted into the radially outwardly opening grooves on the outer edge of the sealing plate segment which is associated with them, wherein the plurality of sealing ring segments each include two long ends, facing away from each other, which are formed in each case by a bend which engages with a cutout provided in the radially outwardly opening groove so that the plurality of sealing ring segments are fastened in a form-fitting manner on the outer edge in the circumferential direction.

2. The axial turbomachine rotor as claimed in claim 1, wherein the projection has a radially inwards opening groove in which the outer edge engages in a radially movable manner and against a base of which the sealing ring bears.

3. The axial turbomachine rotor as claimed in claim 1, wherein the plurality of sealing plate segments are interconnected in the circumferential direction in each case by a recessed edge.

4. The axial turbomachine rotor as claimed in claim 1, wherein each bend is designed as a leg which is of an L-shaped form in an axial direction.

5. The axial turbomachine rotor as claimed in claim 4, wherein each leg includes a curvature radius which is at least greater than half a longitudinal extent of the leg.

6. The axial turbomachine rotor as claimed in claim 4, wherein the two legs of each sealing ring segment point in opposite directions so that the sealing ring segment is of a Z-shaped form.

7. The axial turbomachine rotor as claimed in claim 1, wherein the plurality of sealing ring segments are designed as a band with an oblong cross section, the long sides of which extend in a radial direction and an outer short side of which may bear against the blade root.

8. The axial turbomachine rotor as claimed in claim 7, wherein the cross section is a rectangular cross section.

* * * * *